US008779983B1

(12) United States Patent
Lam et al.

(10) Patent No.: US 8,779,983 B1
(45) Date of Patent: Jul. 15, 2014

(54) TRIANGULAR APERTURES WITH EMBEDDED TRIFILAR ARRAYS

(75) Inventors: Lawrence K. Lam, San Jose, CA (US); Samuel J. Waldbaum, Mountain View, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 800 days.

(21) Appl. No.: 12/751,161

(22) Filed: Mar. 31, 2010

Related U.S. Application Data

(60) Provisional application No. 61/169,547, filed on Apr. 15, 2009.

(51) Int. Cl.

| | |
|---|---|
| ***H01Q 21/20*** | (2006.01) |
| ***H01Q 3/24*** | (2006.01) |
| ***H01Q 21/06*** | (2006.01) |
| ***H01Q 1/28*** | (2006.01) |

(52) U.S. Cl.
CPC ..... *H01Q 21/205* (2013.01); *H01Q 21/061* (2013.01); *H01Q 3/24* (2013.01); *H01Q 1/288* (2013.01)
USPC ..... 343/700 MS; 343/844

(58) Field of Classification Search
CPC . H01Q 21/061; H01Q 21/065; H01Q 21/205; H01Q 3/24
USPC ..... 343/700 MS, 844, 895; 342/374
See application file for complete search history.

(56) References Cited

U.S. PATENT DOCUMENTS

| | | | | |
|---|---|---|---|---|
| 4,335,388 | A * | 6/1982 | Scott et al. | 342/379 |
| 5,457,465 | A * | 10/1995 | Collier et al. | 342/374 |
| 6,292,134 | B1 * | 9/2001 | Bondyopadhyay | 342/374 |
| 7,528,782 | B2 | 5/2009 | Baliarda et al. | |
| 2003/0076274 | A1 * | 4/2003 | Phelan et al. | 343/895 |
| 2006/0097946 | A1 | 5/2006 | McCarville et al. | |

* cited by examiner

*Primary Examiner* — Robert Karacsony
*Assistant Examiner* — Amal Patel
(74) *Attorney, Agent, or Firm* — Fraser Clemens Martin & Miller LLC; J. Douglas Miller

(57) ABSTRACT

A first plurality of antenna elements is arranged in a lattice structure to form trifilar subarrays having a generally hexagonal perimeter. A second plurality of the trifilar subarrays is arranged into substantially equilateral triangular facets that may be combined into substantially planar elements to create geometric apertures of a conformal antenna structure. The geometric apertures may be combined to form conformal antennas approximating hemispherical, spherical or cylindrical structures.

20 Claims, 5 Drawing Sheets

TRIANGULAR APERTURES WITH EMBEDDED TRIFILAR ARRAYS

STATEMENT REGARDING FEDERALLY SPONSORED RESEARCH OR DEVELOPMENT

Not applicable.

CROSS-REFERENCE TO RELATED APPLICATIONS

The present application claims priority to U.S. Provisional Application Ser. No. 61/169,547 filed Apr. 15, 2009.

FIELD OF THE INVENTION

The invention relates to electronically scanned array antennas. In particular, the invention relates to conformal three-dimensional antennas having triangular apertures with embedded trifilar arrays.

BACKGROUND OF THE INVENTION

Electronically scanned array ("ESA") antennas are commonly used in air, space and ground communication systems. These array antennas comprise multiple antenna elements whose radiation patterns are constructively combined to form antenna beams. By controlling the phase and/or amplitude of the signal fed to the individual antenna elements, the generated antenna beams are electronically shaped and scanned in a desired direction. Because the antenna beam is controlled electronically, these array antennas require minimal mechanical structure and moving parts, and are preferred for use on satellite communication systems.

The radiation pattern of an array antenna is the product of the array pattern and the radiation pattern of the individual antenna elements in the array. Desired radiation pattern characteristics, such as high directivity, low side lobes, and the absence of grating lobes, are sought after by modifying the array pattern and/or the individual antenna elements. For example, the directivity of an array antenna can be increased by increasing the aperture size of the array antenna. If a sparse array is used to obtain the larger aperture size, however, grating lobes can be generated in the radiation pattern thereby reducing the directivity of the array antenna.

Another desirable feature of array antennas is the ability to operate in multiple frequency bands and/or transmit multiple signals. For example, transmission array antennas are often required to transmit two different signals. Conventional array antennas often meet this requirement by using antenna elements designed to radiate both signals. However, when both signals pass through a twodimensional circuit within the array antenna, intermodulation products from third order mixing can cause spurious signals to appear in or near the pass-bands associated with the intended transmission signals.

It is known that a spherical array ESA is the optimal choice for ground-based satellite control antennas, because the spherical array ESA delivers excellent performance with a minimum number of antenna elements. However, the fabrication and assembly of curved array surfaces is difficult and costly. One known ESA design that approximates a spherical design is the geodesic dome antenna. A geodesic dome is an approximation of a sphere, generally made out of triangles connected by straight edges. A geodesic dome ESA provides the advantages of a spherical ESA, such as uniform beams over a hemisphere, high gain, high instantaneous bandwidth, low mismatch and polarization losses, and low life cycle costs. Thus, for example, U.S. Pat. No. 6,292,134 discloses a known ESA design that utilizes a plurality of near equilateral triangular flat panel subarrays arranged in an icosahedral geodesic dome configuration to create a faceted dome antenna.

Commonly owned U.S. Pat. No. 7,466,287, incorporated by reference herein in its entirety, discloses a sparse trifilar array antenna wherein multiple antenna elements forming an array antenna are arranged to form two-dimensional arrays approximately aligned to a triangular lattice structure. An array antenna is also disclosed having two groups of antenna elements. A first group of antenna elements is arranged in a first group of three two-dimensional arrays. A second group of antenna elements is arranged in a second group of three two-dimensional arrays. All of the antenna elements are aligned to a lattice structure with the antenna elements of each two-dimensional array being arranged in adjacent lattice positions. The first group of two-dimensional arrays is arranged to occupy lattice positions between the second group of two-dimensional arrays. The trifilar array configurations allow for multiple beam, wide angle scan coverage.

It is desirable to adapt the trifilar array antenna of U.S. Pat. No. 7,466,287 to a conformal antenna aperture to create a low cost, easily implemented conformal aperture capable of handing multiple beam, wide angle scan coverage.

SUMMARY OF THE INVENTION

Concordant and consistent with the present invention, a triangular aperture with embedded trifilar subarrays has been discovered. A plurality of trifilar subarrays are arranged into substantially equilateral triangular facets that may be combined into substantially planar elements to create geometric apertures of a conformal antenna structure. The geometric apertures may be combined to form conformal antennas approximating spherical or cylindrical structures.

In one embodiment, the trifilar subarrays are sparse trifilar subarrays, allowing implementation with one-half of the number of antenna elements required to fully populate a conventional array, while maintaining approximately the same beamwidth. The inventive arrangement of arranging array elements in a sparse trifilar array configuration reduces the symmetry of larger arrays comprising multiple sparse trifilar arrays. The inventive arrangement also minimizes grating lobes in the radiation pattern of the larger array antennas.

In another embodiment, a multi-faceted, conformal, phased array antenna system is provided that includes a plurality of independent geometric antenna apertures formed into a conformal structure, the plurality of independent geometric antenna apertures formed from a plurality of trifilar antenna arrays.

BRIEF DESCRIPTION OF THE DRAWINGS

The above, as well as other advantages of the present invention, will become readily apparent to those skilled in the art from the following detailed description of the preferred embodiment when considered in the light of the accompanying drawings in which.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner.

Figure 1:
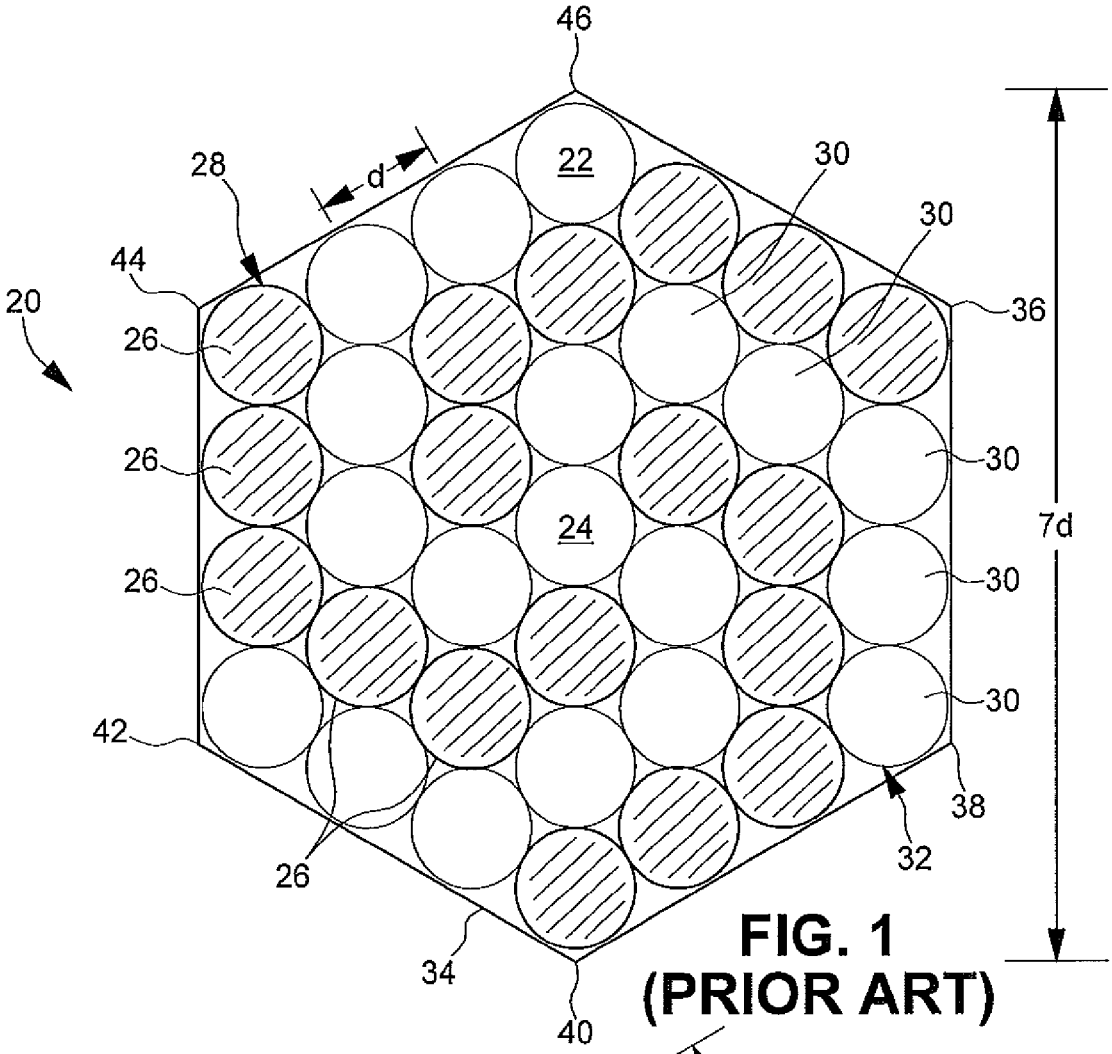
FIG. 1 (PRIOR ART)
FIG. 1 is a diagram depicting a trifilar subarray configuration, including the geometry associated therewith.

The trifilar subway 20 that forms the basic building block for the present invention is shown in FIG. 1, multiple embodiments of which are fully described in commonly owned U.S. Pat. No. 7,466,287. The trifilar subarray 20 is comprised of a plurality of antenna elements 22 arranged in an efficient triangular lattice structure having a center-to-center spacing d. In FIG. 1, a total of 36 antenna elements 22 are combined, with a vacant lattice position 24 centrally located within the trifilar subarray 20. It is understood that the total number of antenna elements 22 that form the trifilar subarray 20 may be more or less than 36 antenna elements. In particular, a "sparse" configuration of antenna elements 22 is known wherein one-half of the antenna elements 22 are omitted and are replaced with vacant spaces, as discussed in detail in U.S. Pat. No. 7,466,287. However, other antenna element configurations are applicable to the present invention.

A first group of antenna elements 26 depicted as shaded circles is arranged into a first set 28 of three two-dimensional arrays each including six antenna elements 22, while a second group of antenna elements 30 depicted as blank circles is arranged into a second set 32 of three two-dimensional arrays, each including six antenna elements 22. The second set 28 of two-dimensional arrays may comprise vacant spaces within the trifilar subarray 20, or may comprise a second independent set of antenna elements within the trifilar subarray 20.

The equilateral triangle lattice structure arrangement of the antenna elements 22 within the trifilar array 20 defines a perimeter hexagon 34 having six corners (starting from the upper right) 36, 38, 40, 42, 44, 46. The geometric locations in (x, y) unit vector space relative to the center of the centrally located vacant lattice position 24, defined as the origin, for each of the six corners 36, 38, 40, 42, 44, 46 may be described, for example, as applicable to the position of hexagon 34 on a circuit board, as a function of the center-to-center spacing d as shown in Table 1. Additionally, the maximum corner-to-corner spacing of the hexagon 34 is 7 d for a trifilar subarray 20 having 36 antenna elements 22.

TABLE 1

| | x | y |
|---|---|---|
| Corner 36 | $d * (3\sqrt{3} + 1)/2)$ | $d * (1.5 + \sqrt{3}/6)$ |
| Corner 38 | $d * (3\sqrt{3} + 1)/2)$ | $-d * (1.5 + \sqrt{3}/6)$ |
| Corner 40 | 0 | $-d * (3 + 1/\sqrt{3})$ |
| Corner 42 | $-d * (3\sqrt{3} + 1)/2)$ | $-d * (1.5 + \sqrt{3}/6)$ |
| Corner 44 | $-d * (3\sqrt{3} + 1)/2)$ | $d * (1.5 + \sqrt{3}/6)$ |
| Corner 46 | 0 | $d * (3 + 1/\sqrt{3})$ |

Figure 2:
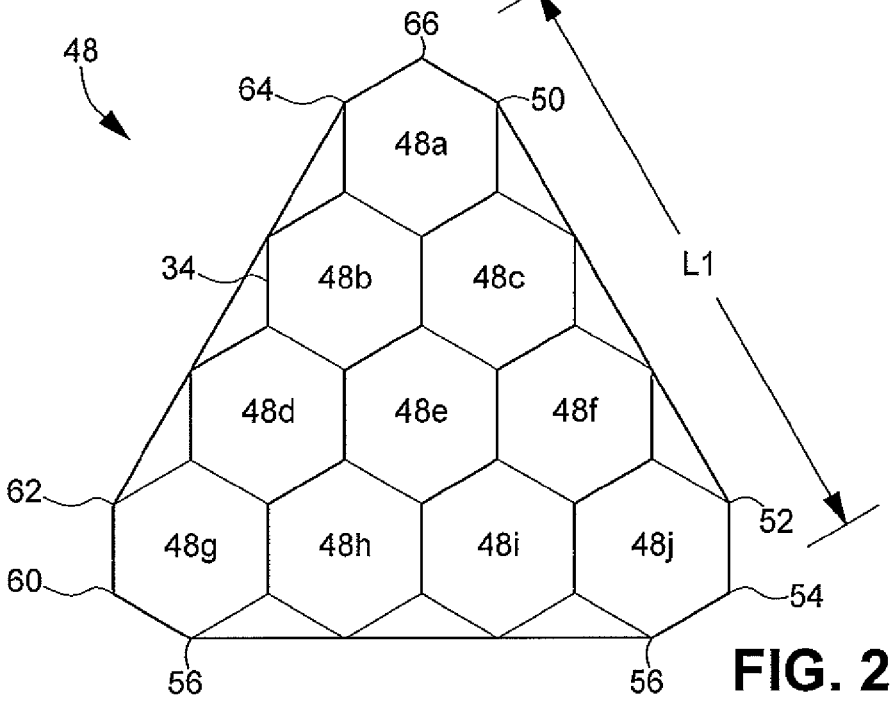
FIG. 2 is a diagram depicting a plurality of trifilar subways arranged in a substantially equilateral triangular facet having four trifilar arrays per triangle side.

A plurality of hexagons 34 including the trifilar array 20 may be combined to form various geometric shapes. FIG. 2 shows a substantially equilateral triangular facet 48 formed from ten hexagons 48*a-j* arranged having four hexagons 34 on each side. In one alternative configuration, the triangular facet 48 may be formed only by hexagons 34 along a perimeter of the triangular facet 48, thereby omitting hexagon 48*e*. For ease of reference, the triangular facet 48 will be referred to as the facet4 48, indicating the use of four hexagons 34 on each side thereof. As shown in Table 2, the geometric locations in (x, y) unit vector space relative to the center of the hexagon 48*e*, defined as the origin, of each of nine points 50, 52, 54, 56, 58, 60, 62, 64, 66 that define the perimeter of the facet4 48 may be described as a function of the center-to-center spacing d (FIG. 1) of each antenna element 22. It is understood that the geometric locations shown in Table 2 represent a minimum dimension and size of the facet4 48, with minimal or no spacing between individual hexagons 34. It is further understood that the hexagons 34 may be spaced apart as desired. When spacing between adjacent hexagons 34 is minimized, the length L1 along each side of the facet4 48 may be calculated to be approximately 24.785*d, as shown in Equation 1.

$$L1 = d*(4+24\sqrt{3}/2) \approx 24.785*d \qquad \text{Eq. 1}$$

Thus, for example, if d, representing the center-to-center spacing of each antenna element 22, equals 3 inches, then L1 is equal to approximately 74.355 inches, or approximately 6.196 feet. In the embodiment shown, each facet4 48 includes 360 individually controllable antenna elements 22, allowing for multiple beam, wide angle scan coverage. In a sparse trifilar array arrangement, wherein half of the antenna elements are omitted, the facet4 48 includes 180 individually controllable antenna elements 22.

TABLE 2

| | x | y |
|---|---|---|
| Corner 50 | $d * (0.5 + 3\sqrt{3}/2)$ | $d * (10.5 + 7\sqrt{3}/6)$ |
| Corner 52 | $d * (2 + 6\sqrt{3})$ | $-d * (3 + \sqrt{3}/3)$ |
| Corner 54 | $d * (2 + 6\sqrt{3})$ | $-d * (6 + 2\sqrt{3}/3)$ |
| Corner 56 | $d * (1.5 + 9\sqrt{3}/2)$ | $-d * (7.5 + 5\sqrt{3}/6)$ |
| Corner 58 | $-d * (1.5 + 9\sqrt{3}/2)$ | $d * (7.5 + 5\sqrt{3}/6)$ |
| Corner 60 | $-d * (2 + 6\sqrt{3})$ | $-d * (6 + 2\sqrt{3}/3)$ |
| Corner 62 | $-d * (2 + 6\sqrt{3})$ | $-d * (3 + \sqrt{3}/3)$ |
| Corner 64 | $-d * (0.5 + 3\sqrt{3}/2)$ | $d * (10.5 + 7\sqrt{3}/6)$ |
| Corner 66 | 0 | $d * (3 + 1/\sqrt{3})$ |

Figure 3:
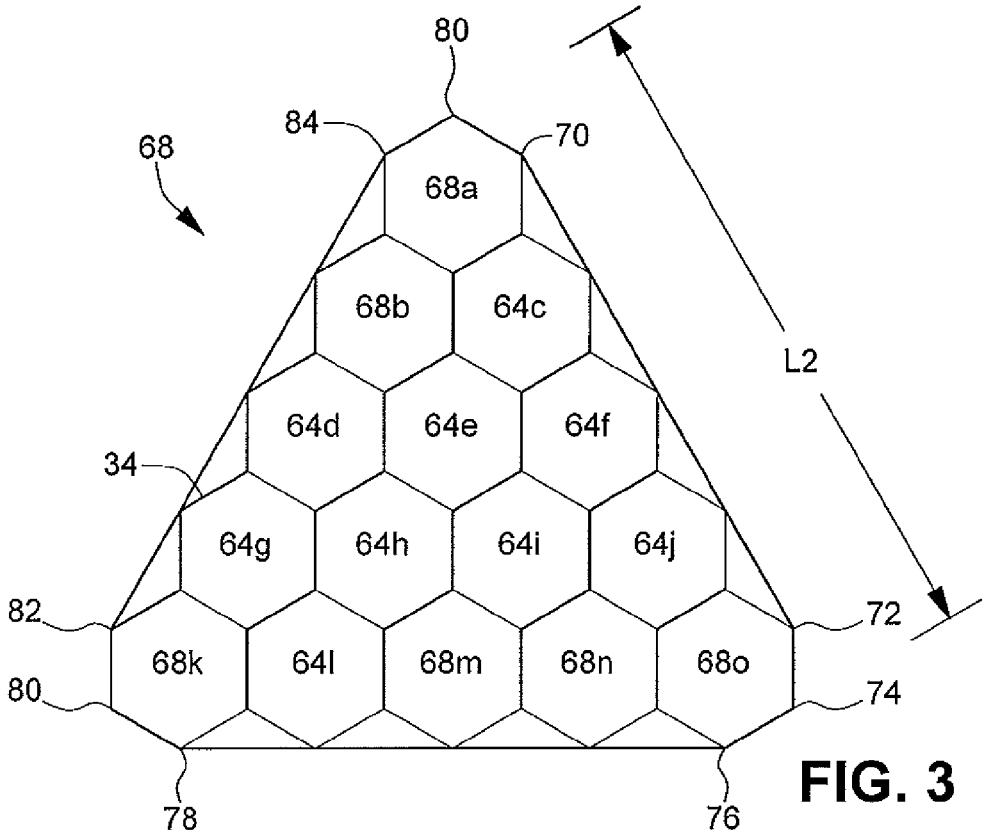
FIG. 3 is a diagram depicting a plurality of trifilar subarrays arranged in a substantially equilateral triangular facet having five trifilar subways per triangle side.

FIG. 3 shows a substantially equilateral triangular facet 68 formed from fifteen hexagons 68*a-o* arranged having five hexagons 34 on each side. In one alternative configuration, the triangular facet 68 may be formed only by hexagons 34 along a perimeter of the triangular facet 68, thereby omitting hexagons 64*e*, 64*h* and 64*i*. For ease of reference, the triangular facet 68 will be referred to as the facet5 68, indicating the use of five hexagons 34 on each side thereof. As shown in Table 3, the geometric locations in (x, y) unit vector space relative to the center of the hexagon 68*e*, defined as the origin, of each of nine points 70, 72, 74, 76, 78, 80, 82, 84, 86 that define the perimeter of the facet5 68 may be described as a function of the center-to-center spacing d (FIG. 1) of each antenna element 22. It is understood that the geometric locations shown in Table 3 represent a minimum dimension and size of the facet5 68, with minimal or no spacing between individual hexagons 34. It is further understood that the hexagons 34 may be spaced apart as desired. When spacing between adjacent hexagons 34 is minimized, the length L2 along each side of the facet5 68 may be calculated to be approximately 30.981*d, as shown in Equation 2.

$$L2=d*(5+15\sqrt{3})\approx 30.981*d \qquad \text{Eq. 2}$$

Thus, for example, if d, representing the center-to-center spacing of each antenna element 22, equals 3 inches, then L2 is equal to approximately 92.943 inches, or approximately 7.745 feet. In the embodiment shown, each facet5 68 includes 540 individually controllable antenna elements 22, allowing for multiple beam, wide angle scan coverage. In a sparse trifilar array arrangement, wherein half of the antenna elements are omitted, the facet5 68 includes 270 individually controllable antenna elements 22.

TABLE 3

| | x | y |
|---|---|---|
| Corner 70 | $d * (0.5 + 3\sqrt{3}/)2$ | $d * (10.5 + 7\sqrt{3}/6)$ |
| Corner 72 | $d * (2.5 + 15\sqrt{3}/2)$ | $-d * (3 + \sqrt{3}/3)$ |
| Corner 74 | $d * (2.5 + 15\sqrt{3}/2)$ | $-d * (6 + 2\sqrt{3}/3)$ |
| Corner 76 | $d * (1.5 + 9\sqrt{3}/2)$ | $-d * (12 + 4\sqrt{3}/3)$ |
| Corner 78 | $-d * (1.5 + 9\sqrt{3}/2)$ | $-d * (12 + 4\sqrt{3}/3)$ |
| Corner 80 | $-d * (2.5 + 15\sqrt{3}/2)$ | $-d * (6 + 2\sqrt{3}/3)$ |
| Corner 82 | $-d * (2.5 + 15\sqrt{3}/2)$ | $-d * (3 + \sqrt{3}/3)$ |
| Corner 84 | $-d * (0.5 + 3\sqrt{3}/2)$ | $d * (10.5 + 7\sqrt{3}/6)$ |
| Corner 86 | 0 | $d * (12 + 4\sqrt{3}/3)$ |

Figure 4:
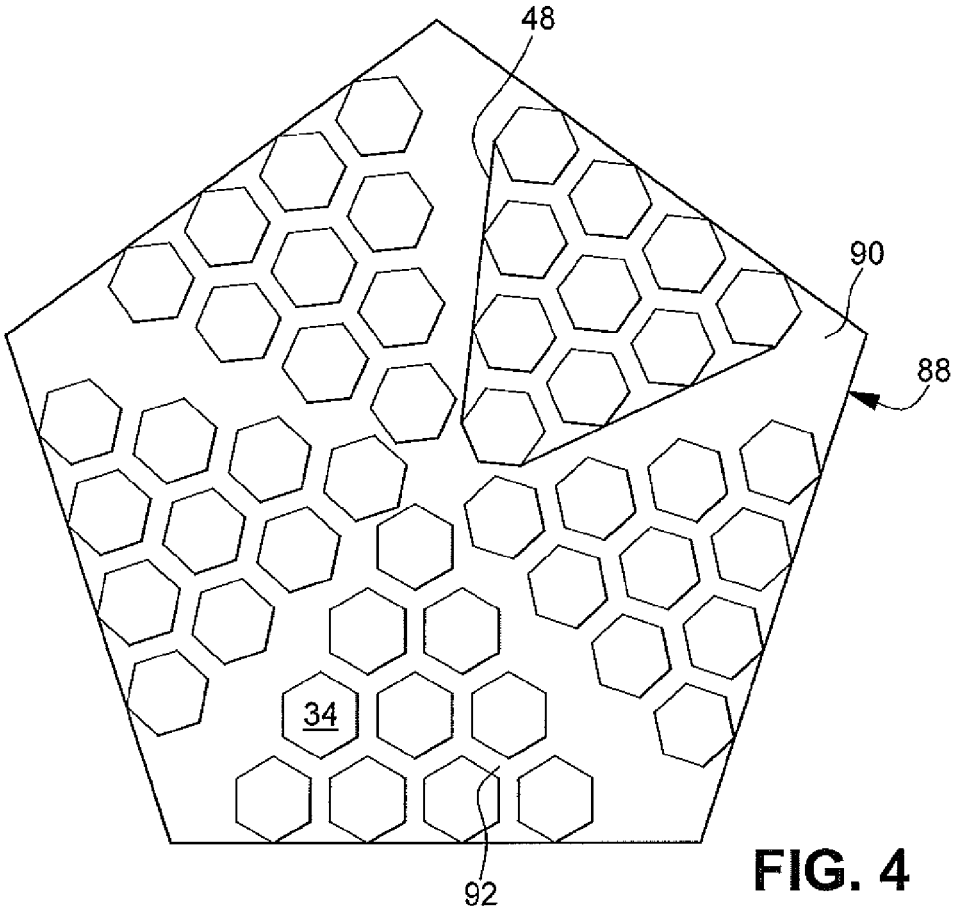
FIG. 4 is a diagram depicting a plurality of triangular facets having four trifilar subarrays per triangle side arranged to form a substantially planar pentagon shaped aperture.

According to the present invention, a plurality of substantially triangular facet4s 48 and facet5s 68 of the present invention may be used to form various geometric aperture configurations. For example, FIG. 4 shows a pentagon shaped aperture 88 composed of five triangular facet4s 48, totaling 1800 individually controllable antenna elements, or 900 individually controllable antenna elements in a sparse array configuration. The locations of each facet4 48 relative to others in the pentagon shaped aperture 88 are variable and may be optimized for a given application. It is understood that different sizes of the pentagon shaped apertures 88 may be formed by providing more or less space 90 between each facet4 48 that forms the pentagon shaped aperture 88. It is further understood that the spacing 92 between each individual hexagon 34 within each facet4 may be adjusted for each application, and different forms of the pentagon shaped aperture 88 may be combined and applied within the same application as desired. Best results have been found where a single pentagon shaped aperture 88 is designed for an application to allow for standardization and interchangeability.

Figure 5:
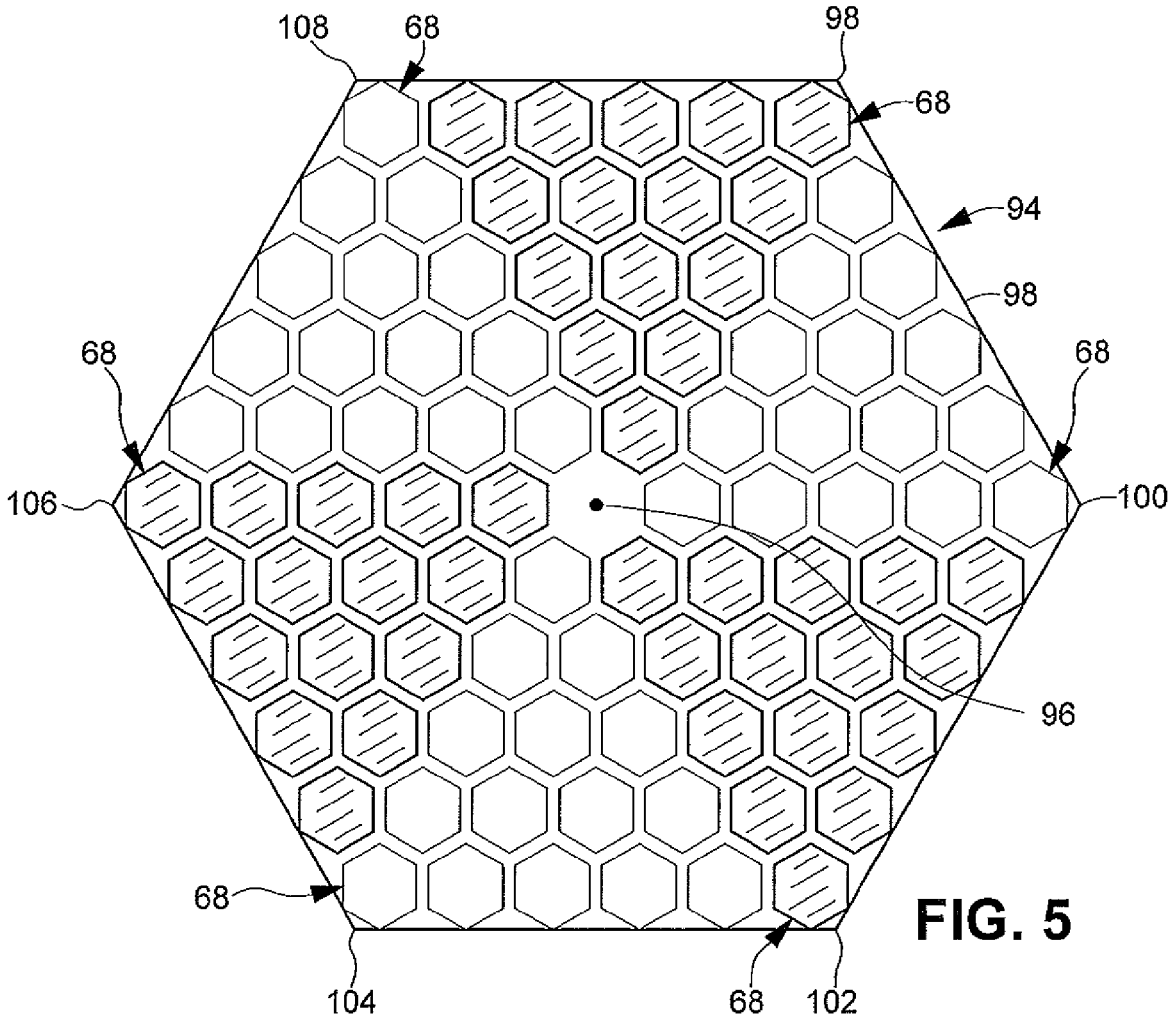
FIG. 5 is diagram depicting a plurality of triangular facets having five trifilar subarrays per triangle side arranged to form a substantially planar hexagon shaped aperture.

Similarly, FIG. 5 shows six separate facet5s 68 arranged to form a hexagonally shaped aperture 94, totaling 3240 individually controllable antenna elements, or 1620 individually controllable antenna elements in a sparse array configuration. As shown in Table 4, the geometric locations in (x, y) unit vector space relative to the center 96 of the hexagonally shaped aperture 94, defined as the origin, of each of the six points 98, 100, 102, 104, 106, 108 that define the substantially hexagonal perimeter 98 of the hexagonally shaped aperture 94 may be described as a function of the center-to-center spacing d (FIG. 1) of each antenna element 22. It is understood that the geometric locations shown in Table 4 represent a minimum dimension and size of the hexagonally shaped aperture 94 based on a minimum size of each facet5 68, with minimal or no spacing between individual and adjacent facet5s 68. It is further understood that the size of the hexagonally shaped aperture 94 may be altered by either increasing or decreasing the spacing between each individual hexagon 34 within each facet5 68 or by increasing or decreasing the size of each facet. For example, each facet could be formed having six or more hexagons 34 on each side to increase the size of the facet, and correspondingly increasing the number of individually controllable antenna elements and the size of the hexagonally shaped aperture 94.

TABLE 4

| | x | y |
|---|---|---|
| Corner 98 | $d * (3.5 + 21/\sqrt{3})$ | $d * (21 + 7\sqrt{3}/2)$ |
| Corner 100 | $d * (7 + 42/\sqrt{3})$ | 0 |
| Corner 102 | $d * (3.5 + 21/\sqrt{3})$ | $-d * (21 + 7\sqrt{3}/2)$ |
| Corner 104 | $-d * (3.5 + 21/\sqrt{3})$ | $-d * (21 + 7\sqrt{3}/2)$ |
| Corner 106 | $-d * (7 + 42/\sqrt{3})$ | 0 |
| Corner 108 | $-d * (3.5 + 21/\sqrt{3})$ | $d * (21 + 7\sqrt{3}/2)$ |

Figure 6:
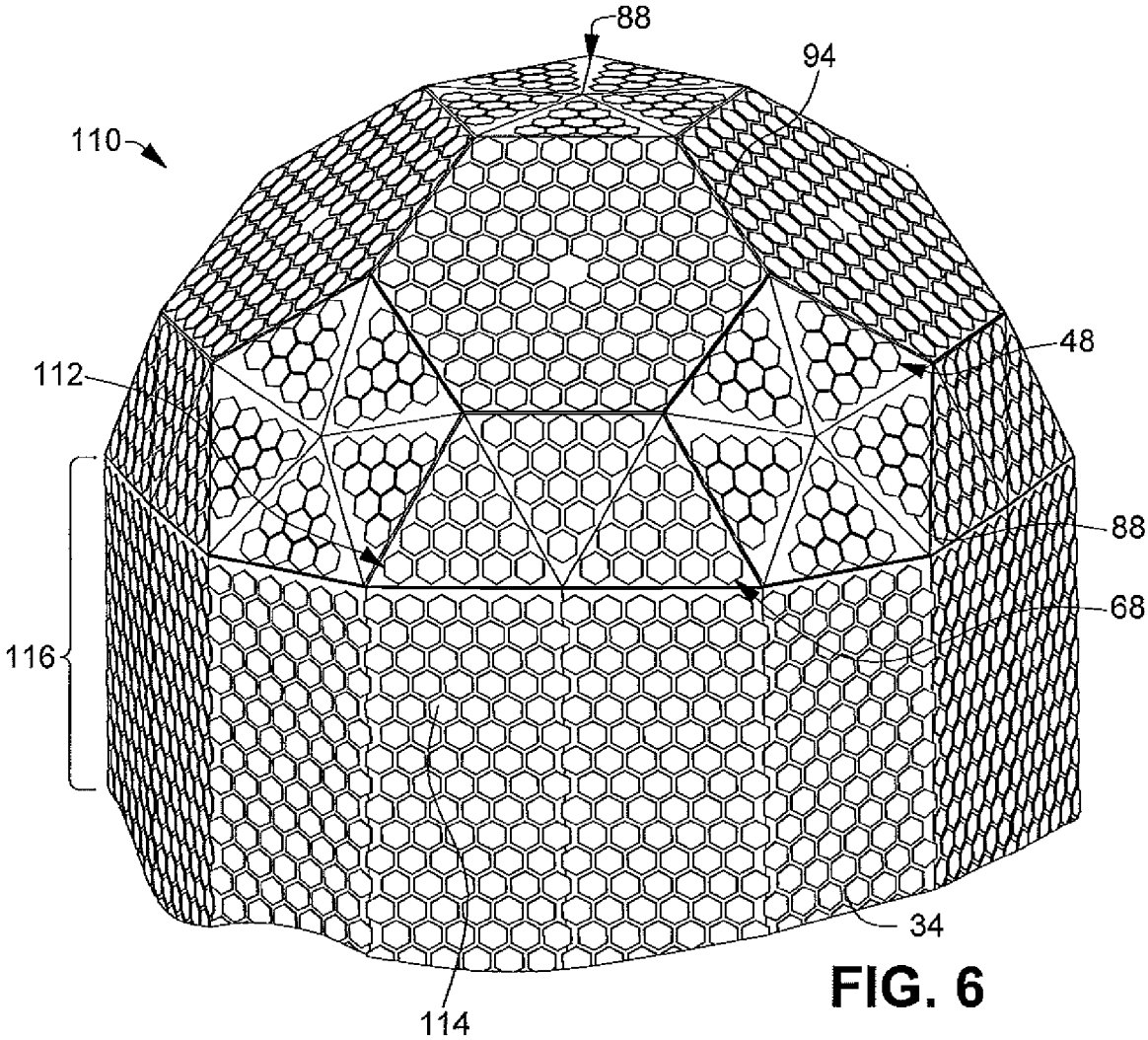
FIG. 6 is a diagram depicting a substantially hemispherically dome-shaped conformal phased array antenna system formed according to an embodiment of the present invention.

The facet4 48, the facet5 68, the pentagon shaped aperture 88 and the hexagon shaped aperture 94 may further be combined in numerous ways to form complex arrays approximating curved surfaces. One embodiment, shown with reference to FIG. 6, constructs a substantially hemispherical antenna 110 from a plurality of hexagon shaped apertures 94 and pentagon shaped apertures 88. Additionally, where desired, half-hexagon shaped apertures 112 may be formed from three facet5s 68. Additionally, a plurality of hexagons 34 may be combined to form a substantially trapezoidal shaped aperture 114. In FIG. 6, the trapezoidal shaped apertures 114 are configured as substantially vertically oriented rectangular apertures, and may be sized and shaped as required to construct the conformal hemispherical antenna 110, and may further be used to form a cylindrical portion 116 of an antenna. It is understood that the trapezoidal shaped apertures 114 may have any orientation, including horizontal, to construct the cylindrical portion 116 of an antenna.

Figure 7:
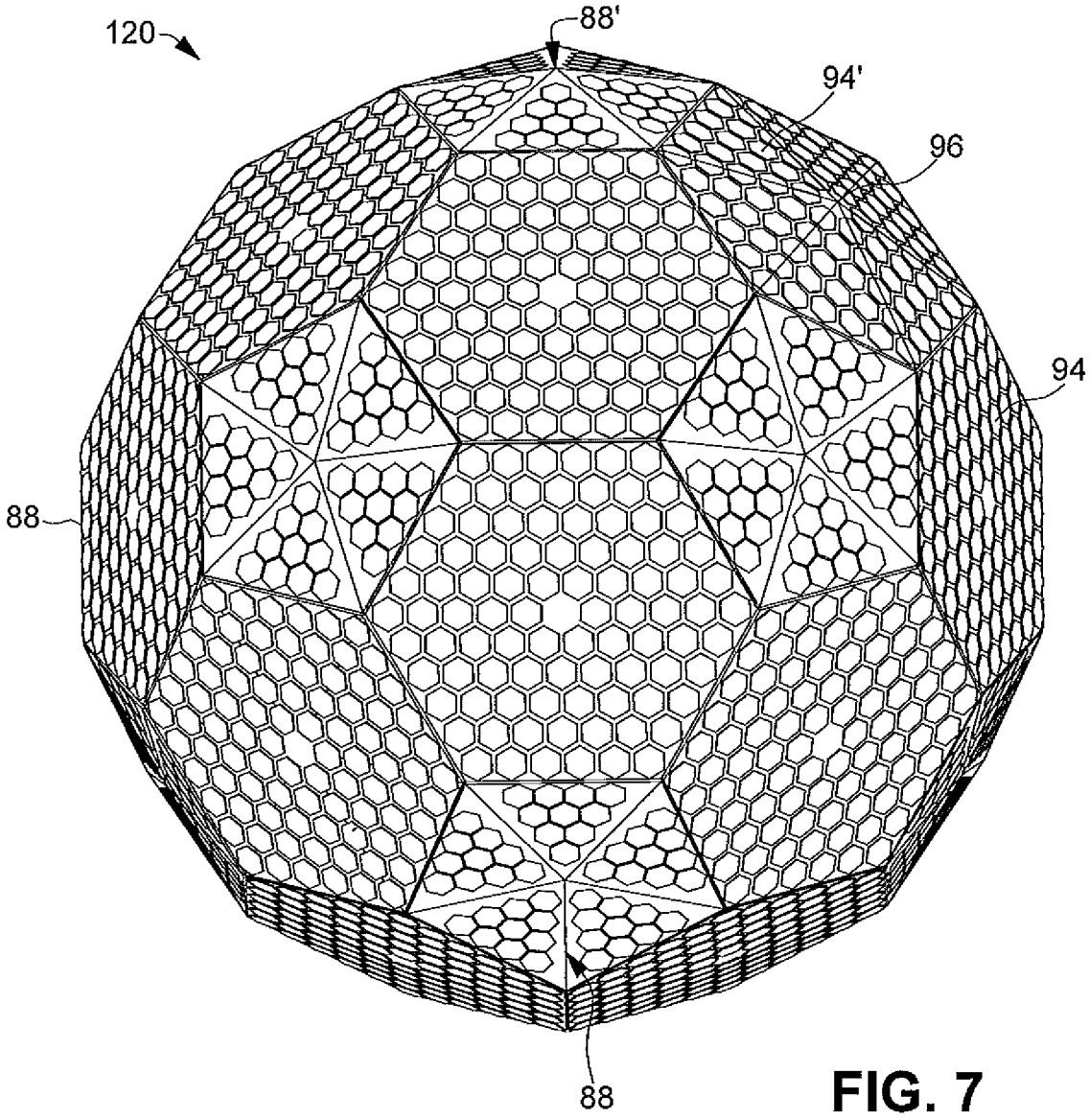
FIG. 7 is a diagram depicting a substantially spherically shaped conformal phased array antenna system formed according to an embodiment of the present invention.

Another embodiment, shown in FIG. 7, constructs a substantially spherical conformal antenna 120 using only a plurality of pentagon shaped apertures 88 and hexagon shaped apertures 94. It is understood that the exact placement of each pentagon shaped aperture 88 and hexagon shaped aperture 94 may be optimized for any given application, and may vary from installation to installation. The pentagon shaped apertures 88 and the hexagon shaped apertures 94 are depicted in FIG. 7 as being substantially planar. In an alternative configuration, pentagon shaped apertures 88' and hexagon shaped apertures 94' may be constructed having a more conformal shape, wherein the pentagon shaped apertures 88' and hexagon shaped apertures 94' are non-planar. For example, in the hexagon shaped apertures 94' shown in FIG. 7, the center 96 of the hexagon shaped aperture 94' is located outside of a plane defined by individual corners of the hexagon shaped aperture 94' so that the hexagon shaped aperture 94' more closely approximates a segment of the substantially spherical conformal antenna 120.

Thus, the triangular apertures using hexagonal trifilar arrays 34 configured as facet4s 48 and facet5s 68 may be combined into substantially planar pentagon shaped apertures 88 and hexagon shaped apertures 94, respectively, or may me combined into non-planar pentagon shaped apertures 88' and non-planar hexagon shaped apertures 94', which may further be combined to approximate curved surfaces in conformal antenna arrays. The conformal antenna array may be formed of all planar apertures, all non-planar apertures, or any combination thereof. When combined into substantially hemispherical or substantially spherical configurations, the antennas of the present invention provide optimal ground-based satellite control by delivering excellent performance with a minimum number of antenna elements, including multiple beams, multiple frequencies, uniform beams over a hemisphere, high gain, high instantaneous bandwidth, low mismatch and polarization losses, and low life cycle costs. Each facet may be constructed from identical subcomponent trifilar arrays 34, which substantially reduces manufacturing cost while improving quality and standardization. The aperture facets of the present invention reduce the symmetry of larger arrays comprising multiple sparse trifilar arrays, while minimizing grating lobes in the radiation pattern of the larger array antennas.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. An array antenna, comprising:

a plurality of independent substantially hexagonal shaped trifilar subarrays arranged into a substantially equilateral triangular facet, each side of the substantially equilateral triangular facet including an equal number of hexagonal shaped trifilar subarrays, wherein each trifilar subarray further comprises:

a plurality of antenna elements arranged in three non-linear arrays, wherein the plurality of antenna elements is aligned to a lattice structure with the antenna elements of each non-linear array arranged in adjacent lattice positions, and wherein the three non-linear arrays are separated by vacant lattice positions.

2. The array antenna of claim 1, wherein the trifilar subarrays are sparse subarrays.

3. The array antenna of claim 1, wherein ten of the substantially hexagonal shaped trifilar subarrays are arranged to form a substantially equilateral triangular facet having four of the trifilar subarrays on each side.

4. The array antenna of claim 3, wherein five of the substantially equilateral triangular facets each having four of the trifilar subarrays on each side are further arranged to form a substantially pentagon shaped aperture.

5. The array antenna of claim 4, wherein the substantially pentagon shaped aperture forms at least a portion of a conformal antenna.

6. The array antenna of claim 5, wherein the conformal antenna is shaped as one of a sphere, a hemisphere, and a cylinder.

7. The array antenna of claim 1, wherein fifteen of the substantially hexagonal shaped trifilar subarrays are arranged to form a substantially equilateral triangular facet having five of the trifilar subarrays on each side.

8. The array antenna of claim 7, wherein six of the substantially equilateral triangular facets each having five of the trifilar subarrays on each side are further arranged to form a substantially hexagonal shaped aperture.

9. The array antenna of claim 8, wherein the substantially hexagonal shaped aperture forms at least a portion of a conformal antenna.

10. The array antenna of claim 9, wherein the conformal antenna is shaped as one of a sphere, a hemisphere, and a cylinder.

11. An array antenna, comprising:

a first plurality of independent geometric antenna apertures arranged to form a conformal antenna, at least one of the independent geometric antenna apertures formed from a plurality of substantially equilateral triangular facets formed from a plurality of independent trifilar subarrays, each of the trifilar subarrays comprising:

a plurality of antenna elements arranged in three non-linear arrays, wherein the plurality of antenna elements is aligned to a lattice structure with the antenna elements of each non-linear array arranged in adjacent lattice positions, and wherein the three non-linear arrays are separated by vacant lattice positions;

each of the trifilar subarrays defining a generally hexagonal perimeter, wherein each side of each of the substantially equilateral triangular facets includes an equal number of the trifilar subarrays.

12. The array antenna of claim 11, wherein each side of the substantially equilateral triangular facets includes four of the trifilar subarrays.

13. The array antenna of claim 11, wherein each side of the substantially equilateral triangular facets includes five of the trifilar subarrays.

14. The array antenna of claim 11, wherein each side of the substantially equilateral triangular facets is a generally planar array.

15. The array antenna of claim 11, wherein at least one of the independent geometric antenna apertures is one of a pentagon, a half hexagon, a hexagon, and a trapezoid.

16. The array antenna of claim 15, wherein the conformal antenna is shaped as one of a sphere, a hemisphere, and a cylinder.

17. The array antenna of claim 16, wherein the trifilar subarrays are sparse subarrays.

18. An array antenna, comprising:

a first plurality of antenna elements arranged in a first group of three two-dimensional arrays;

a second plurality of antenna elements arranged in a second group of three two-dimensional arrays, wherein the first and second plurality of antenna elements are aligned to a lattice structure with the antenna elements of each two-dimensional array arranged in adjacent lattice positions to define a trifilar subarray having a substantially hexagonal perimeter, the trifilar subarray comprising:

a plurality of antenna elements arranged in three non-linear arrays, wherein the plurality of antenna elements is aligned to a lattice structure with the antenna elements of each non-linear array arranged in adjacent lattice positions, and wherein the three non-linear arrays are separated by vacant lattice positions; and a plurality of independent trifilar subarrays arranged into a substantially equilateral triangular facet, each side of the substantially equilateral triangular facet including an equal number of the trifilar subarrays.

19. The array antenna of claim 18, wherein a plurality of substantially equilateral triangular facets is arranged to form independent geometric antenna apertures.

20. The array antenna of claim 19, wherein a plurality of independent geometric antenna apertures is combined to form a conformal antenna having one of a substantially hemispherical shape, a substantially spherical shape, and a substantially cylindrical shape.

* * * * *